US005877974A

United States Patent [19]

Can

[11] Patent Number: 5,877,974

[45] Date of Patent: Mar. 2, 1999

[54] FOLDED ANALOG SIGNAL MULTIPLIER CIRCUIT

[75] Inventor: Sümer Can, Cupertino, Calif.

[73] Assignee: National Semiconductor Corporation, Santa Clara, Calif.

[21] Appl. No.: 909,025

[22] Filed: Aug. 11, 1997

[51] Int. Cl.[6] ..... G06G 7/16

[52] U.S. Cl. ..... 364/841

[58] Field of Search ..... 364/841; 327/357

[56] References Cited

U.S. PATENT DOCUMENTS 4,586,155 4/1986 Gilbert ..... 364/841
5,115,409 5/1992 Stepp ..... 364/841
5,389,840 2/1995 Dow ..... 364/841

OTHER PUBLICATIONS

Jaime Ramirez–Angulo and Sun Ming–Shen, "The Folded Gilbert Cell: A Low Voltage High Performance CMOS Multiplier", New Mexico State University, Department of Electrical and Computer Engineering, pp. 20–23, Aug. 1992.

*Primary Examiner*—Tan V. Mai
*Attorney, Agent, or Firm*—Limbach & Limbach L. L. P.

[57] ABSTRACT

A four-quadrant analog signal multiplier circuit with a folded cascode differential input stage allows such circuit to be operated at lower power supply voltage potentials, while allowing the same transistor types to be used for both sets of input signals thereby providing for more closely matched input device characteristics and signal gains.

6 Claims, 4 Drawing Sheets

FOLDED ANALOG SIGNAL MULTIPLIER CIRCUIT

BACKGROUND OF THE INVENTION

1. Field of the Invention

The present invention relates to analog signal multiplier circuits, and in particular, to four-quadrant analog signal multiplier circuits.

2. Description of the Related Art

Referring to FIG. 1, four-quadrant analog signal multiplier circuits, such as that shown, are well known in the art. The two differential analog input signals 11*a*, 11*b* are multiplied together with three interconnected differential amplifiers 12, 14, 16 to produce a differential analog output signal 13. One input signal 11*b* drives the lower differential amplifier 12 which, in turn, drives the upper differential amplifiers 14, 16. This type of amplifier structure is well known in the art. For example, U.S. Pat. No. 4,586,155 (a disclosure of which is incorporated herein by reference) discloses a number of variations of such a circuit.

Referring to FIG. 2, this type of amplifier can also be implemented using metal oxide semiconductor field effect transistors (MOSFETs) interconnected in a similar manner. As with the bipolar junction transistor circuit 10 of FIG. 1, in this MOSFET circuit 20 one input signal 21*b* drives the lower differential amplifier 22 which, in turn, drives the upper differential amplifiers 24, 26, and the output signal 23 is the product of the two input signals 21*a*, 21*b*. This MOSFET implementation is particularly useful for low power applications due to the lower power requirements of MOSFET devices. The overall circuit gain in terms of its transconductance, i.e., its differential output current ($I_{O(diff)} = I_{O1} - I_{O2}$) as a function of its differential input voltages ($V_a$, $V_b$), can be expressed by the following equations (with the various voltages and currents identified as indicated in FIG. 2 and β as transconductance):

$$I_{D1} = I_B + i = \beta(V_{GS1} - V_T)^2 \tag{1}$$

$$I_{D2} = I_B - i = \beta(V_{GS2} - V_T)^2 \tag{2}$$

$$V_{GS1} = \sqrt{\frac{I_{D1}}{\beta}} + V_T = \sqrt{\frac{I_B + i}{\beta}} + V_T \tag{3}$$

$$V_{GS2} = \sqrt{\frac{I_{D2}}{\beta}} + V_T = \sqrt{\frac{I_B - i}{\beta}} + V_T \tag{4}$$

$$V_b = V_{GS1} - V_{GS2} = \frac{1}{\sqrt{\beta}}\left(\sqrt{I_B + i} - \sqrt{I_B - i}\right) \tag{5}$$

$$\sqrt{\beta}\ V_b = \sqrt{I_B + i} - \sqrt{I_B - i} \tag{6}$$

$$\sqrt{\beta}\ V_b = \sqrt{I_B}\left[\sqrt{1 + \frac{i}{I_B}} - \sqrt{1 - \frac{i}{I_B}}\right] \tag{7}$$

$$\text{For } x << 1: \sqrt{1 + x} - \sqrt{1 - x} \approx \left(1 + \frac{x}{2}\right) - \left(1 - \frac{x}{2}\right) = x$$

$$\sqrt{\beta}\ V_b = \sqrt{I_B}\ \frac{i}{I_B} \tag{8}$$

$$i = \sqrt{\beta}\ \sqrt{I_B}\ V_b \tag{9}$$

$$\text{For } i << I_B: V_b << \sqrt{\frac{I_B}{\beta}}$$

-continued $$I_{D1} \approx I_B + \sqrt{\beta}\ \sqrt{I_B}\ V_b \tag{10}$$

$$I_{D2} \approx I_B - \sqrt{\beta}\ \sqrt{I_B}\ V_b \tag{11}$$

$$I_{O1} = I_{D3} + I_{D5} \tag{12}$$

$$I_{O2} = I_{D4} + I_{D6} \tag{13}$$

$$I_{O(diff)} = I_{O1} - I_{O2} = I_{D3} + I_{D5} - I_{D4} - I_{D6} \tag{14}$$

$$I_{O(diff)} = (I_{D3} - I_{D4}) - (I_{D6} - I_{D5}) \tag{15}$$

$$I_{D3} = I_{D1} + \sqrt{\beta}\ \sqrt{I_{D1}}\ V_a \tag{16}$$

$$I_{D4} = I_{D1} - \sqrt{\beta}\ \sqrt{I_{D1}}\ V_a \tag{17}$$

$$I_{D5} = I_{D2} + \sqrt{\beta}\ \sqrt{I_{D2}}\ V_a \tag{18}$$

$$I_{D6} = I_{D2} - \sqrt{\beta}\ \sqrt{I_{D2}}\ V_a \tag{19}$$

Substitute Equations (16)–(19) into (15):

$$I_{O(diff)} = 2\sqrt{\beta}\ V_a\left(\sqrt{I_{D1}} - \sqrt{I_{D2}}\right) \tag{20}$$

Substitute Equations (10)–(11) into (20):

$$\begin{aligned} I_{O(diff)} &= 2\sqrt{\beta}\ V_a\left[\sqrt{I_B + \sqrt{\beta}\ \sqrt{I_B}\ V_b} - \sqrt{I_B - \sqrt{\beta}\ \sqrt{I_B}\ V_b}\right] \\ &= 2\sqrt{\beta}\ V_a\sqrt{I_B}\left[\sqrt{1 + \frac{\sqrt{\beta}}{\sqrt{I_B}}\ V_b} - \sqrt{1 - \frac{\sqrt{\beta}}{\sqrt{I_B}}\ V_b}\right] \\ &\approx 2\sqrt{\beta}\ V_a\sqrt{I_B}\left[\frac{\sqrt{\beta}}{\sqrt{I_B}}\ V_b\right] \end{aligned} \tag{21}$$

$$I_{O(diff)} \approx 2\beta V_a V_b \tag{22}$$

$$\text{where: } V_b << \frac{\sqrt{I_B}}{\beta} \text{ and } V_a << \sqrt{\frac{I_B}{2\beta}}$$

This type of circuit, however, does have one characteristic which has become increasingly disadvantageous. Due to their stacked arrangement, i.e., where a pair of differential amplifiers 14/24, 16/26 is effectively stacked upon another differential amplifier 12/22 between the two power supply rails, the dynamic signal range becomes quite limited in a low power applications. In other words, as these types of circuits 10, 20 are required to operate at lower power supply voltages, saturation and/or cutoff of the transistors begins to occur at correspondingly lower signal magnitudes. This requires reduced input in output signal amplitudes, thereby decreasing signal-to-noise ratios.

Referring to FIG. 3, the stacked arrangement of differential amplifiers can be avoided by "folding" what used to be the "lower" differential amplifier 32 such that it is biased between the two power supply rails in a manner similar to what used to be the "upper" differential amplifiers 34, 36. However, while this circuit topography may allow for circuit operation at lower power supply voltages, it does require different types of input devices. Whereas in the stacked amplifier configuration 20 (FIG. 2) the lower differential amplifier 22 used the same types of transistors as the upper differential amplifiers 24, 26 (e.g., N-type MOSFETs), in the folded amplifier configuration 30 (FIG. 3) the folded differential amplifier 32 uses different types of transistors than the output amplifiers 34, 36 (e.g., P-type MOSFETs instead of N-type MOSFETs). This has the disadvantage of making it more difficult to maintain matched input device characteristics and signal gains since, for example, the device characteristics and signal gains of P-type MOSFETs and N-type MOSFETs do not track one another well over variations in device sizes and manufacturing processes.

Accordingly, it would be desirable to have a similarly simple multiplier circuit structure which does not sacrifice performance at reduced signal amplitudes and which provides for more closely matched device characteristics and signal gains.

SUMMARY OF THE INVENTION

A folded cascode analog signal multiplier circuit in accordance with the present invention allows lower power supply voltages to be used without requiring reduced signal amplitudes. Accordingly, signal-to-noise ratios similar to those of conventional multiplier circuits can be maintained even while operating at lower power supply voltages. Additionally, a folded cascode analog signal multiplier circuit in accordance with the present invention allows the same transistor types to be used for both sets of input signals, thereby providing for more closely matched input device characteristics and signal gains.

In accordance with one embodiment of the present invention, a folded cascode analog signal multiplier circuit includes a differential cascode amplifier circuit and two differential amplifier circuits. The differential cascode amplifier circuit includes: first and second bias terminals configured to receive first and second source currents; a third bias terminal configured to provide a first sink current; input terminals configured to receive a first input signal; and output terminals configured to provide a first output signal which corresponds to the first input signal and provide respective portions of second and third sink currents. The first differential amplifier circuit includes: input terminals configured to receive a second input signal; a bias terminal coupled to one of the differential cascode amplifier circuit output terminals and configured to receive a portion of the first output signal and provide another portion of the second sink current; and output terminals configured to receive respective portions of third and fourth source currents. The second differential amplifier circuit includes: input terminals coupled to the first differential amplifier circuit input terminals and configured to receive the second input signal; a bias terminal coupled to the other differential cascode amplifier circuit output terminal and configured to receive another portion of the first output signal and provide another portion of the third sink current; and output terminals coupled to the first differential amplifier circuit output terminals and configured to receive further respective portions of the third and fourth source currents. The coupled output terminals of the first and second differential amplifier circuits together are configured to provide a second output signal which represents a product of the two input signals.

These and other features and advantages of the present invention will be understood upon consideration of the following detailed description of the invention and the accompanying drawings.

DETAILED DESCRIPTION OF THE INVENTION

Figure 1:
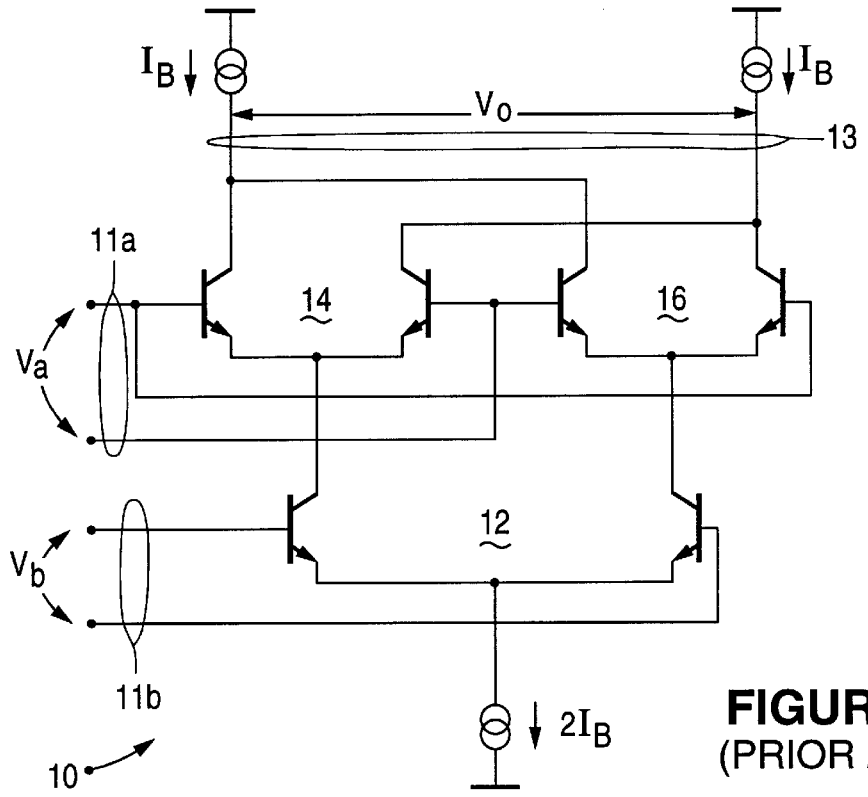
FIGURE 1 (PRIOR ART)
FIG. 1 is a schematic diagram of a conventional four-quadrant multiplier circuit using bipolar junction transistors.
Figure 2:
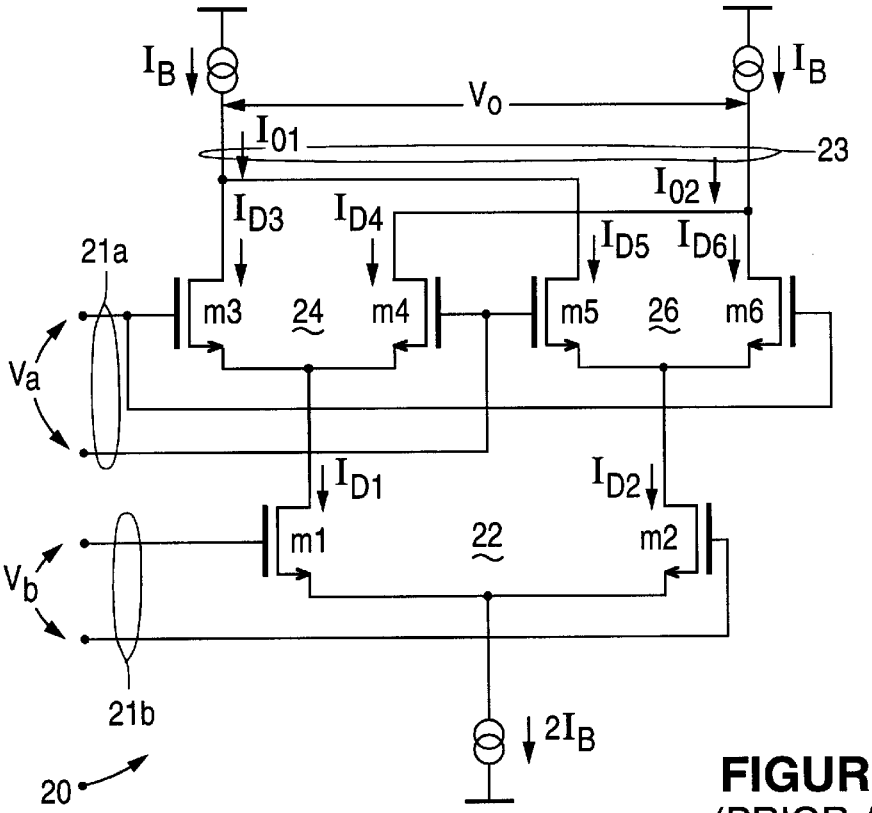
FIGURE 2 (PRIOR ART)
FIG. 2 is a schematic diagram of a conventional four-quadrant multiplier circuit using MOSFETs.
Figure 3:
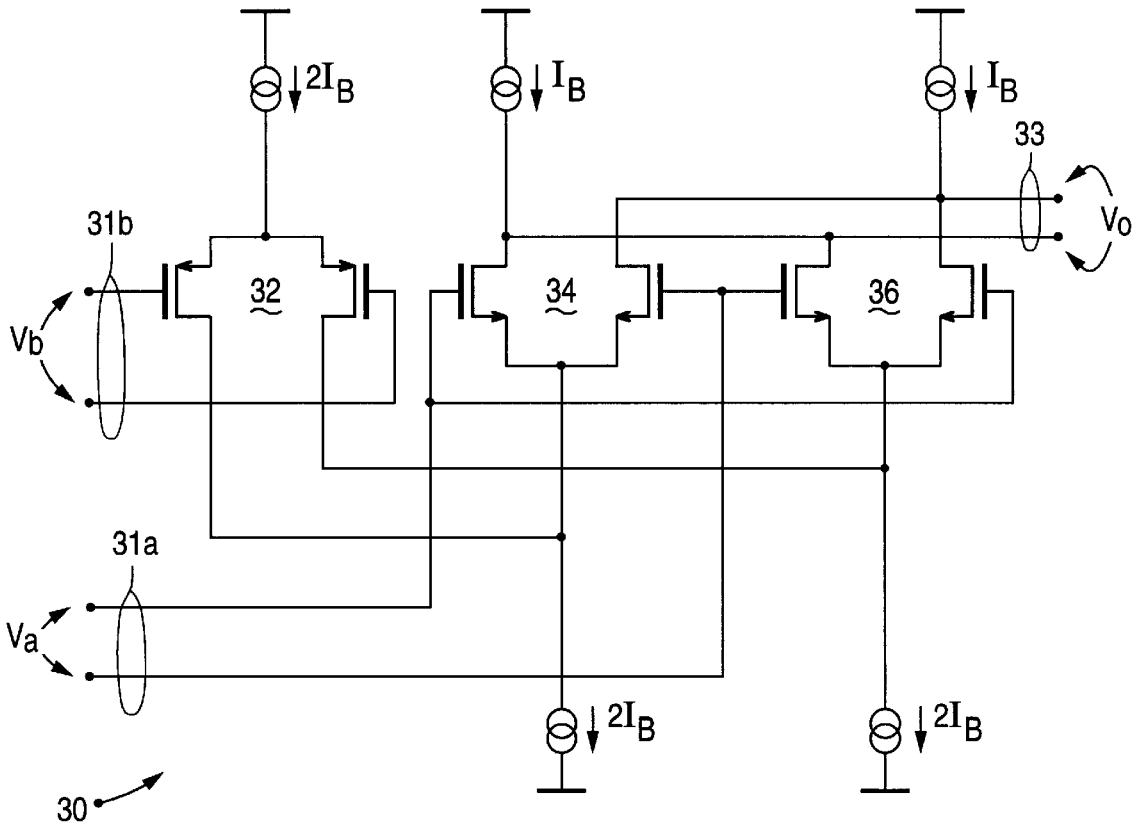
FIGURE 3 (PRIOR ART)
FIG. 3 is a schematic diagram of a conventional folded four-quadrant multiplier circuit using MOSFETs.
Figure 4:
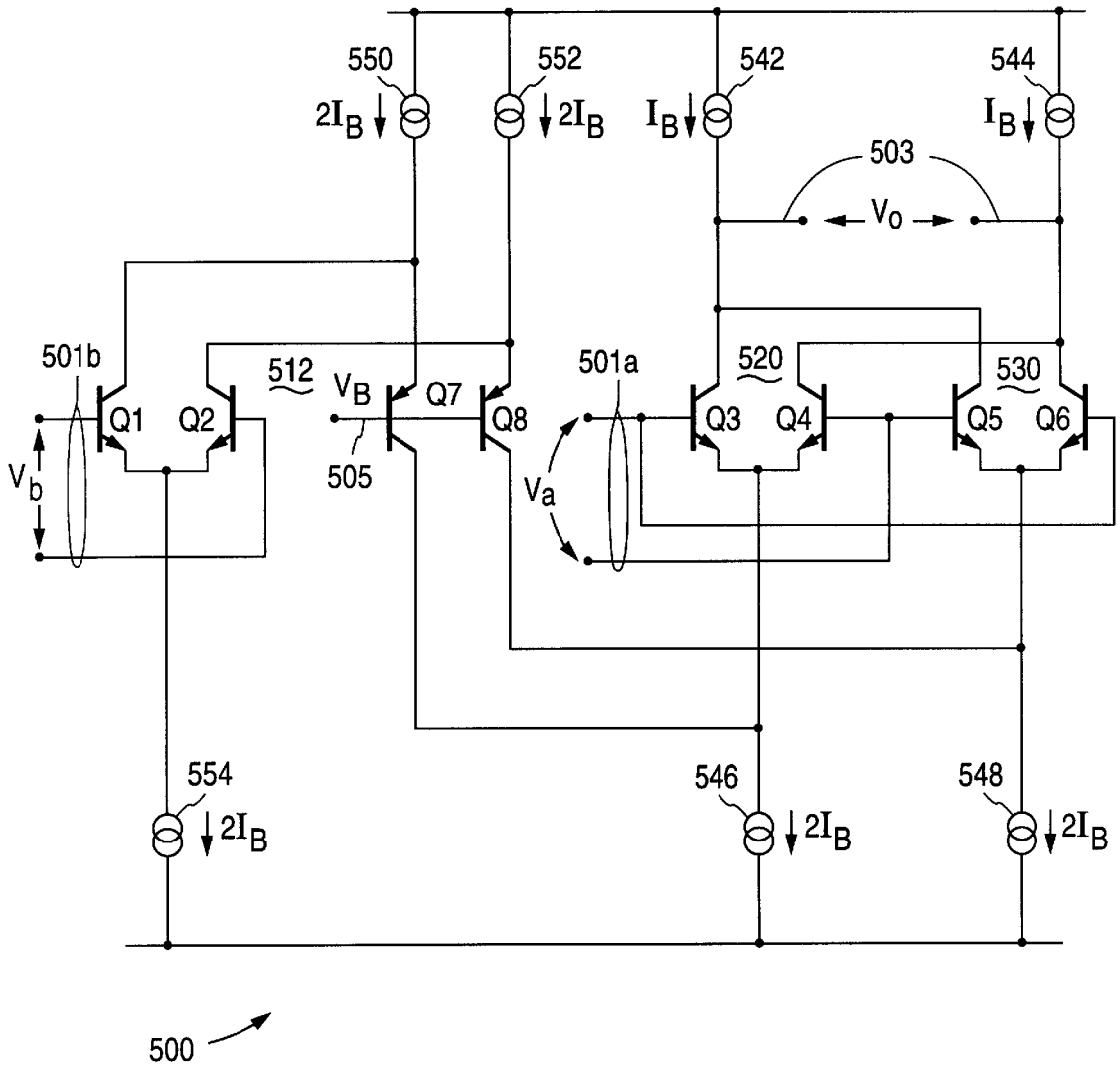
FIG. 4 is a schematic diagram of a folded cascode analog signal multiplier circuit in accordance with one embodiment of the present invention.

Referring to FIG. 4, a folded cascode analog signal multiplier circuit 500 in accordance with one embodiment of the present invention includes a differential cascode "input" amplifier 512 and two differential "output" amplifiers 520, 530 driven by four current source circuits 550, 552, 542, 544 and three current sink circuits 546, 548, 554, all interconnected substantially as shown. The current $2I_B$ from the first source current circuit 550 is shared by the collector and emitter of cascode connected transistors Q1 and Q7, respectively, while the current $2I_B$ from the second source current circuit 552 is shared by the collector and emitter of cascode connected transistors Q2 and Q8, respectively. The emitter currents of transistors Q1 and Q2 combine to form the current $2I_B$ for the first current sink circuit 554. The third source current circuit 542 provides a source current $I_B$ which is shared by the collectors of transistors Q3 and Q5 and the fourth source current circuit 544 provides a source current $I_B$ which is shared by the collectors of transistors Q4 and Q6 of the "output" differential amplifiers 520, 530. The emitter currents of transistors Q3 and Q4 and collector current of transistor Q7 combine to form the current $2I^B$ for the second current sink circuit 546, while the emitter currents of Q5 and Q6 and collector current of transistor Q8 combine to form the current $2I^B$ for the third current sink circuit 548.

The first differential input signal 501*a* is applied to the base terminals of the differential output amplifiers 520, 530. The second differential input signal 501*b* is applied to the base terminals of the differential cascode input amplifier 512. The resulting differential signal voltage at the collector terminals of transistors Q7 and Q8 drive the emitter terminals of the output amplifiers 520, 530. This results in a differential output signal 503 at the collector terminals of transistors Q3 and Q5 and the collector terminals of transistors Q4 and Q6 which represents a product of the original input signals 501*a*, 501*b*.

While this particular circuit implementation 500 requires at least two additional transistors due to the cascode input stage 512 (in which cascode transistors Q7 and Q8 serve as a current buffer), an advantage of such an implementation is that all of the input devices are of the same type transistor. For example, in this particular bipolar junction transistor implementation, the input devices Q1, Q2 of the differential cascode input amplifier 512 are NPN transistors as are the transistors Q3, Q4, Q5, Q6 of the output amplifiers 520, 530. Accordingly, circuit characteristics associated with the various input signal 501*a*, 501*b* terminals can more easily be matched and maintained due to the similarity of the input devices.

Figure 5:
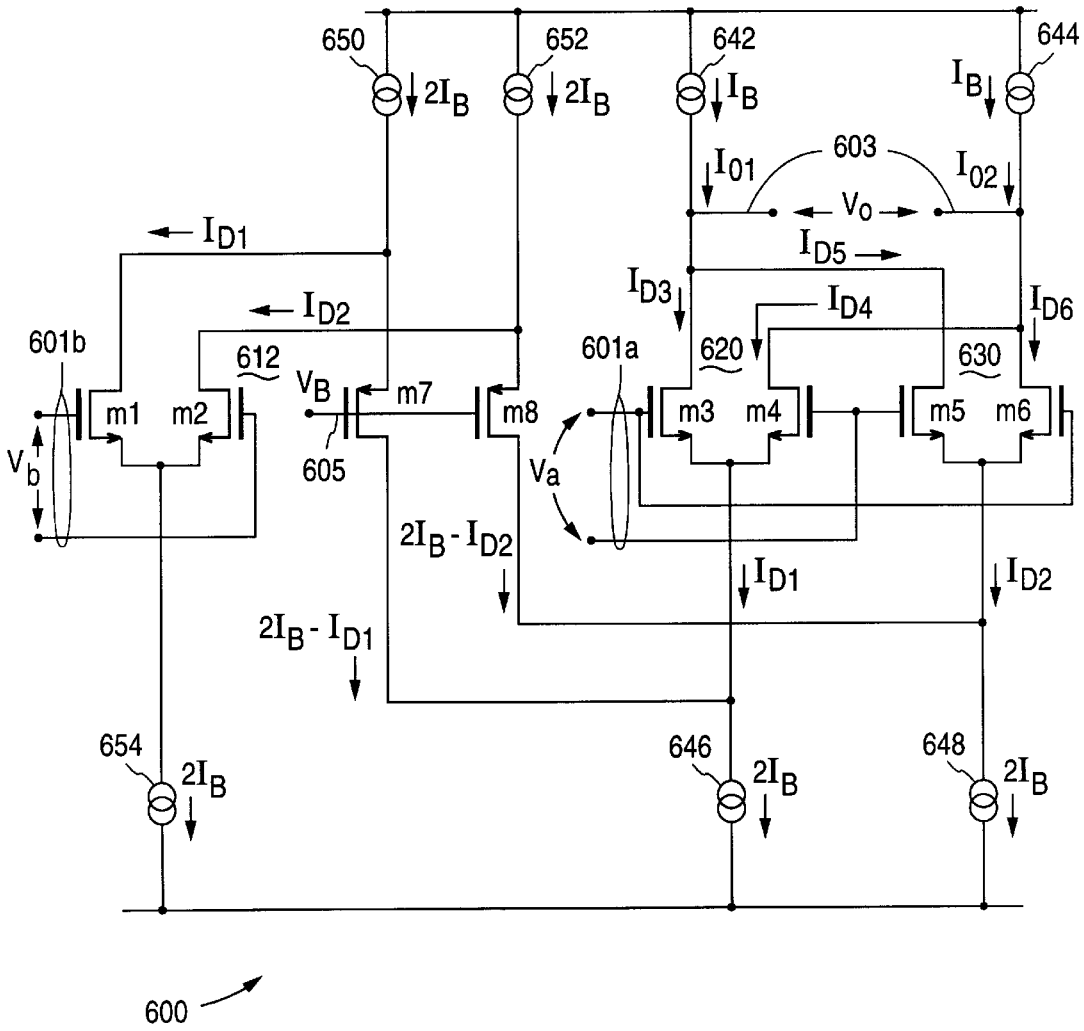
FIG. 5 is a schematic diagram of a folded cascode analog signal multiplier circuit in accordance with another embodiment of the present invention.

Referring to FIG. 5, an alternative embodiment 600 of a folded cascode analog signal multiplier circuit in accordance with the present invention can be implemented with MOSFETs instead of bipolar junction transistors. Accordingly, P-type and N-type MOSFETs are used in place of PNP and NPN bipolar junction transistors, respectively. As with the circuit 500 of FIG. 4, this implementation 600 also has the advantage of identical types of input devices, e.g., N-type MOSFETs M1, M2, M3, M4, M5, M6. The overall circuit gain for this embodiment 600 in terms of its transconductance, i.e., its differential output current ($I_{O(diff)}=I^{O1}-I_{O2}$) as a function of its differential input voltages ($V_a$, $V_b$), can be expressed by Equations (1) through (22) above (with the various voltages and currents identified as indicated in FIG. 5 and β as transconductance).

From the figures and foregoing discussion a number of things should be understood. For example, in each of these circuit embodiments 500, 600, with appropriate reversals of power supply potentials, PNP and NPN devices can be substituted for NPN and PNP devices, respectively, in bipolar junction transistor circuit implementations, and P-type and N-type devices can be substituted for N-type and P-type devices, respectively, in MOSFET circuit implementations. Additionally, a folded analog signal multiplier circuit in accordance with the present invention retains the advantage of a simple structure while having the additional advantage of being operable at lower power supply voltages since only one active circuit stage (other than the current source and sink circuits) is connected between and must operate within the two power supply rail potentials. Hence, for a given range of input and output signal amplitudes, the power supply voltage can be reduced without significantly reducing the signal levels at which any of the amplifier transistors will saturate or cut off. Furthermore, a folded analog signal multiplier circuit in accordance with the present invention provides the advantage of using identical types of input devices, thereby providing for more closely matched input device characteristics and signal gains.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a folded cascode analog signal multiplier circuit, comprising:

a differential cascode amplifier circuit which includes first and second bias terminals configured to receive first and second source currents, a third bias terminal configured to provide a first sink current, first and second input terminals configured to receive a first input signal, and first and second output terminals configured to provide a first output signal which corresponds to said first input signal and provide respective portions of second and third sink currents;

a first differential amplifier circuit which includes third and fourth input terminals configured to receive a second input signal, a fourth bias terminal, coupled to said first output terminal, configured to receive a portion of said first output signal and provide another portion of said second sink current, and third and fourth output terminals configured to receive respective portions of third and fourth source currents; and a second differential amplifier circuit which includes fifth and sixth input terminals, coupled to said third and fourth input terminals, respectively, configured to receive said second input signal, a fifth bias terminal, coupled to said second output terminal, configured to receive another portion of said first output signal and provide another portion of said third sink current, and fifth and sixth output terminals, coupled to said fourth and third output terminals, respectively, configured to receive further respective portions of said fourth and third source currents;

wherein said coupled third and sixth output terminals and said coupled fourth and fifth output terminals together are configured to provide a second output signal which represents a product of said first and second input signals.

2. The apparatus of claim 1, wherein:

said differential cascode amplifier circuit comprises first and second pluralities of metal oxide semiconductor field effect transistors of first and second types; and each one of said first and second differential amplifier circuits comprises a plurality of metal oxide semiconductor field effect transistors of said first type.

3. The apparatus of claim 2, wherein:

said differential cascode amplifier circuit comprises a plurality of N-type metal oxide semiconductor field effect transistors and a plurality of P-type metal oxide semiconductor field effect transistors; and each one of said first and second differential amplifier circuits comprises a plurality of N-type metal oxide semiconductor field effect transistors.

4. The apparatus of claim 1, wherein:

said differential cascode amplifier circuit comprises first and second pluralities of bipolar junction transistors of first and second types; and each one of said first and second differential amplifier circuits comprises a plurality of bipolar junction transistors of said first type.

5. The apparatus of claim 4, wherein:

said differential cascode amplifier circuit comprises a plurality of NPN bipolar junction transistors and a plurality of PNP bipolar junction transistors; and each one of said first and second differential amplifier circuits comprises a plurality of NPN bipolar junction transistors.

6. A method of folded cascode analog signal multiplication, comprising the steps of:

(a) receiving first and second source currents and a first differential input signal and in accordance therewith generating a first sink current, respective portions of second and third sink currents, and a first output signal which corresponds to said first differential input signal;

(b) receiving a second differential input signal, a portion of said first output signal and respective portions of third and fourth source currents and in accordance therewith generating another portion of said second sink current;

(c) receiving said second differential input signal, another portion of said first output signal and further respective portions of said third and fourth source currents and in accordance therewith generating another portion of said third sink current; and (d) generating, in accordance with said steps (b) and (c), a second output signal which represents a product of said first and second differential input signals.

* * * * *